US005306545A

United States Patent [19]

Shirayanagi et al.

[11] Patent Number: 5,306,545

[45] Date of Patent: Apr. 26, 1994

[54] MELT-BLOWN NON-WOVEN FABRIC AND LAMINATED NON-WOVEN FABRIC MATERIAL USING THE SAME

[75] Inventors: Ryutaro Shirayanagi; Akimi Saeki; Kazuhiro Masumoto; Masaki Shimizu, all of Yamaguchi, Japan

[73] Assignee: Mitsui Petrochemical Industries, Ltd., Tokyo, Japan

[21] Appl. No.: 987,807

[22] Filed: Dec. 9, 1992

[30] Foreign Application Priority Data

Dec. 11, 1991 [JP] Japan ..... 3-326264
Dec. 25, 1991 [JP] Japan ..... 3-343698

[51] Int. Cl.[5] ..... B32B 27/14

[52] U.S. Cl. ..... 428/198; 128/206.12; 156/73.1; 156/167; 156/290; 156/308.2; 428/171; 428/172; 428/284; 428/286; 428/296; 428/297; 428/298; 428/903

[58] Field of Search ..... 428/284, 286, 296, 297, 428/298, 903, 198, 171, 172; 156/167, 73.1, 308.2, 290; 128/206.12; 604/304

[56] References Cited

U.S. PATENT DOCUMENTS 4,041,203 8/1977 Brock ..... 428/220
5,188,885 2/1993 Timmons et al. ..... 428/298

*Primary Examiner*—James J. Bell
*Attorney, Agent, or Firm*—Sherman and Shalloway

[57] ABSTRACT

The invention provides a melt-blown non-woven fabric obtained by melt-blowing an ethylene-α-olefin copolymer having a density of smaller than 0.900 g/cm$^3$ and a crystallinity of from 5 to 40% or by melt-blowing a resin composition which chiefly comprises said copolymer, a laminated non-woven fabric obtained by laminating as a unitary structure a dry-type non-woven fabric on the melt-blown fabric that is obtained by melt-blowing said copolymer or the resin composition which chiefly comprises said copolymer, and a cataplasm which comprises the non-woven fabric obtained by melt-blowing said copolymer or said resin composition which chiefly comprises said copolymer, a dry-type non-woven fabric laminated on said melt-blown non-woven fabric, and a medicine layer applied onto said dry-type non-woven fabric. The non-woven fabric or the laminated non-woven fabric has excellent elastic property, i.e., excellent elasticity under the two-dimensional condition, and exhibit excellent fitness to the curved portions and to the stretched or contracted portions. The invention further provides a non-woven fabric obtained by melt-blowing a resin composition which contains 98 to 40% by weight of a polypropylene and 2 to 60% by weight of an ethylene-α-olefin copolymer having a density of smaller than 0.900 g/cm$^3$ and a crystallinity of from 5 to 40%, and a laminated non-woven fabric material using the above non-woven fabric, featuring excellent softness and heat-adhesiveness at low temperatures as well as easy heat-working such as heat-embossing.

35 Claims, 6 Drawing Sheets

FIG. 1(A)
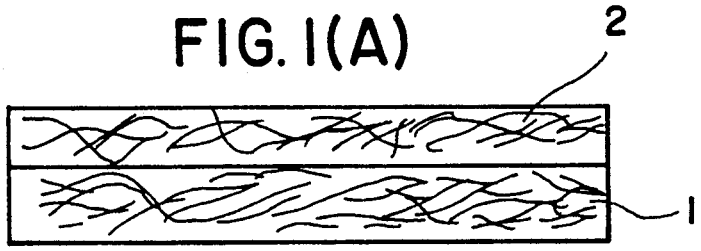
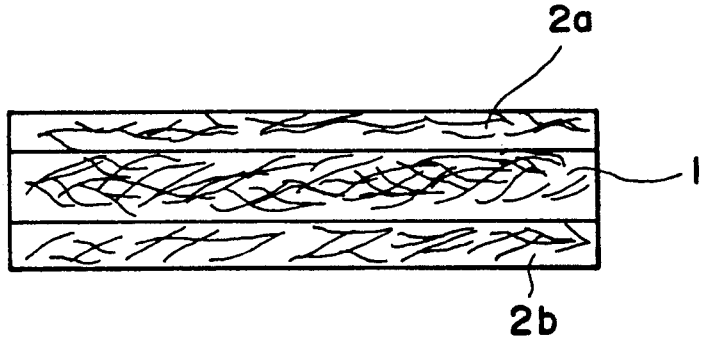
FIG. 1(B)
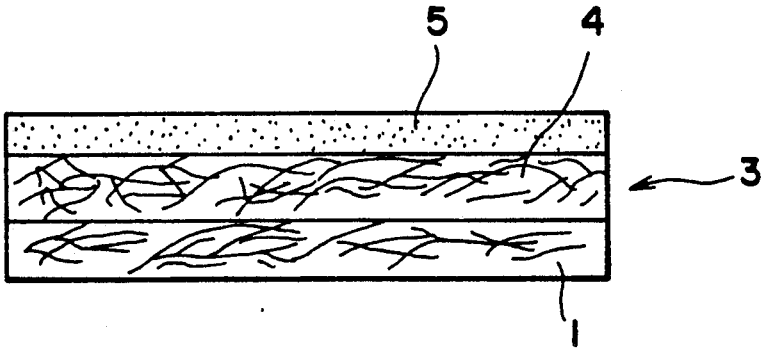
FIG. 2

MELT-BLOWN NON-WOVEN FABRIC AND LAMINATED NON-WOVEN FABRIC MATERIAL USING THE SAME

BACKGROUND OF THE INVENTION

1. Field of the Invention

The present invention relates to a melt-blown non-woven fabric. More specifically, the invention relates to a melt-blown non-woven fabric obtained by using an ethylene-α-olefin copolymer having a particular low crystallinity or a resin composition of a combination of this ethylene-α-olefin copolymer and other resins.

The melt-blown non-woven fabric of the present invention has a feature in that it has excellent softness. In particular, the former melt-blown non-woven fabric obtained by using substantially an ethylene-α-olefin copolymer having a particular low crystallinity is rich in elasticity and has excellent fitness, and the latter melt-blown non-woven fabric obtained by using a resin composition of a combination of the above ethylene-α-olefin copolymer and another resin such as a polypropylene exhibits particularly excellent heat-workability.

The present invention is further concerned with a laminated non-woven fabric material using the above melt-blown non-woven fabric.

2. Description of the Prior Art

A melt-blown non-woven fabric is obtained by extruding a molten resin to form fine resin streams which are then brought into contact with a heated gas of a high speed thereby to obtain non-continuous fibers of fine diameters, and integrating the fibers on a porous support material. The melt-blown non-woven fabric has a relatively soft property and is used for such purposes as clothing and medical supplies.

In such applications, however, the melt-blown non-woven fabric by itself lacks the strength, and means has been employed to reinforce the non-woven fabric by sticking such as of a spun-bonding method or any other method.

For instance, Japanese Patent Publication No. 11148/1985 (corresponds to GB1453447) and U.S. Pat. No. 4,041,203 disclose a non-woven fabric material comprising a web of substantially continuous filaments which have an average filament diameter of greater than about 12 microns and are deposited in a random fashion and are molecularly oriented, and an integrated mat of a largely non-continuous thermoplastic polymeric micro fiber having an average fiber diameter of smaller than about 10 microns and a softening point which is lower by about 10° C. to 40° C. than the softening point of the continuous filaments, wherein the web and the mat are arranged maintaining a laminar relationship and form discretely coupled regions upon the application of heat and pressure.

In producing the non-woven fabric from the polypropylene fiber, furthermore, it has long been known to use a fiber having a low melting point as a so-called binder fiber. For instance, according to Japanese Laid-Open Patent Publication No. 179246/1986, there has been described that a fiber comprising a blend of 65 to 95% by weight of a low-density polyethylene and 5 to 35% by weight of a polypropylene exhibits superior melt-spinnability to that of a polyethylene, and is suited for being used as a binder for the non-woven fabrics. Moreover, Japanese Laid-Open Patent Publication No. 175113/1988 discloses the use of a blend which comprises 99 to 50% by weight of a linear low-density polyethylene that is a copolymer of an ethylene and an octene-1 (1 to 15% by weight), and 1 to 50% by weight of a crystalline polypropylene.

Moreover, Japanese Patent Laid-Open Publication No. 303109/1988 discloses a non-woven fabric of a blended structure obtained by melt-spinning a composition comprising 99 to 50% by weight of a linear low-density polyethylene which is a linear low-density copolymer of an ethylene and at least one kind of an α-olefin with 4 to 8 carbon atoms and substantially containing this α-olefin with 4 to 8 carbon atoms and substantially containing this α-olefin in an amount of 1 to 15% by weight, having a density of from 0.900 to 0.940 g/cm$^3$, a melt index of 25 to 100 g/10 min. (as measured in compliance with the method of ASTM D-1238(E)), and a heat of fusion of 25 cal/g or greater, and 1 to 50% by weight of a crystalline polypropylene having a melt flow rate of smaller than 20 g/10 min. (as measured in compliance with the method of ASTM D-1238(L)).

However, although the melt-blown non-woven fabric obtained from a single thermoplastic resin material such as a polypropylene or the like may exhibit superior softness to the non-woven fabrics of the other types, it still must have particularly excellent elasticity and fitness in addition to the softness when it is used in such applications as clothing, medical supplies, hospital supplies and the like.

Even in the field of cleaning materials, furthermore, it is desired to further improve the softness from the standpoint of fitness to the surfaces to be wiped and adsorption of dust and dirt.

For example, the cataplasm is stuck to an elbow or a knee under a condition where it is slightly bent. However, the cataplasm which uses the currently available non-woven fabric as a base material has its base material deviated without expanded when the hand or the leg is deeply bent or, on the other hand, has its base material greatly wrinkled when the hand or the leg is stretched, causing the medicine to be leaked.

Examples of the currently available elastic fiber materials include spandex yarns and other rubber yarns which, however, are generally expensive and cannot be processed into such a non-woven fabric as a melt-blown non-woven fabric. Thus, there has not yet been provided a non-woven fabric that is rich in elasticity and that exhibits fitness in various applications.

Moreover, heat resistance and mechanical strength are, in many cases, required in combination in addition to softness in such applications as clothing, medical supplies, etc. In order to obtain a non-woven fabric that meets such objects, therefore, means have heretofore been employed to use a fiber having a low melting point as a so-called binder fiber in producing the non-woven fabric from, for example, the polypropylene fiber.

In the non-woven fabric of this kind, however, the binder fiber that bonds to the fiber which carries stress of the non-woven fabric must have a low melting point giving disadvantage from the standpoint of heat resistance of the non-woven fabric thus weakening he cohesive force of the resin which constitutes fibers, i.e., weaking the strength of the non-woven fabric. Moreover, in a process for integrating the non-woven fabric such as by heat-embossing, the processing conditions such as temperature, pressure, processing rate, etc. have small allowance which is not yet satisfactory from the standpoint of workability.

SUMMARY OF THE INVENTION

It is therefore a first object of the present invention to provide a novel melt-blown non-woven fabric which has excellent softness, has by itself excellent elasticity, i.e., has excellent elasticity in its two-dimensional condition, and exhibits excellent fitness to the curved portions or to the expanded or contracted portions, as well as to provide a variety of laminated materials using the above melt-blown non-woven fabric.

A second object of the present invention is to provide a novel elastic melt-blown non-woven fabric that is obtained by melt-blowing a resin composition which chiefly comprises an ethylene-α-olefin copolymer having a particular low crystallinity, as well as to provide laminated non-woven materials using the above melt-blown non-woven fabric.

A third object of the present invention is to provide a melt-blown non-woven fabric that is obtained from a resin composition of a combination of a polypropylene and the above-mentioned particular ethylene-α-olefin copolymer, and that exhibits excellent softness and adhesiveness at low temperatures, and that can be easily heat-worked such as by heat-embossing.

A fourth object of the present invention is to provide a laminated non-woven fabric material using a melt-blown non-woven fabric that is obtained from a resin composition of a polypropylene and an ethylene-α-olefin polymer having a particular low crystallinity, and that has novel thermal properties.

According to the present invention, as a first embodiment, there is provided a melt-blown non-woven fabric which is obtained by melt-blowing an ethylene-α-olefin copolymer having a density of smaller than 0.900 g/cm$^3$ and a crystallinity of from 5 to 40%, or by melt-blowing a resin composition which chiefly comprises the above copolymer.

The above-mentioned ethylene-α-olefin copolymer used for the present invention contains an α-olefin of 3 to 10 carbon atoms, and has an ethylene content of 85 to 95 mole%, a melt flow rate (measured in compliance with MFR: ASTM D1238) of 0.1 to 200 g/10 min. (preferably 1 to 50 g/10 min.) as measured at 190° C. under a load of 2160 g, a density of greater than 0.870 g/cm$^3$ but smaller than 0.900 g/cm$^3$, and a crystallinity of from 5 to 40% as measured by X-rays. Further, it is desired to use the ethylene-α-olefin copolymer having a melting point that lies within a range of from 40° to 100° C.

According to the present invention, furthermore, there is provided a non-woven laminated material obtained by laminating as a unitary structure a non-woven fabric obtained by the dry method and a melt-blown non-woven fabric obtained by melt-blowing the ethylene-α-olefin copolymer having a density of smaller than 0.900 g/cm$^3$ and a crystallinity of from 5 to 40% or by melt-blowing a resin composition which chiefly comprises said copolymer.

According to the present invention, there is further provided a cataplasm comprising a melt-blown non-woven fabric obtained by melt-blowing an ethylene-α-olefin copolymer having a density of smaller than 0.900 g/cm$^3$ and a crystallinity of from 5 to 40% or by melt-blowing a resin composition which chiefly comprises the above copolymer, a dry-method non-woven fabric laminated on the above melt-blown non-woven fabric, and a medicine layer applied onto the dry-method non-woven fabric.

According to the present invention, as a second embodiment, furthermore, there is provided a melt-blown non-woven fabric obtained by melt-blowing a resin composition which contains, with the two components as a reference, 98 to 40% by weight of a polypropylene and 2 to 60% by weight of an ethylene-α-olefin copolymer having a density of smaller than 0.900 g/cm$^3$ and a crystallinity of from 5 to 40%.

In the resin composition constituting the non-woven fabric, the polypropylene should have a softening point (Tf) within a range of 125° to 135° C. and a melting point (Tm) within a range of 160° to 170° C. as measured by the differential scanning calorimetry (DSC). On the other hand, the resin composition of the polypropylene and the ethylene-α-olefin copolymer should have a softening point (Tf) within a range of 120° to 130° C. and a melting point (Tm) of within a range of 160° to 170° C.

Further, the ethylene-α-olefin copolymer used in combination with the polypropylene is the same as the one that is used in the above first embodiment of the present invention.

According to the present invention, furthermore, there is provided a laminated non-woven fabric material obtained by sticking a reinforcing layer or, preferably, a spun-bonded non-woven fabric obtained by the spun-bonding method onto at least one surface of the melt-blown non-woven fabric by the heat-embossing method.

The first embodiment of the present invention is based on a discovery that a non-woven fabric can be formed if an ethylene-α-olefin copolymer having a density of smaller than 0.900 g/cm$^3$ and a crystallinity of from 5 to 40% is melt-blown or if a resin composition chiefly comprising the above copolymer is melt-blown, and that excellent elasticity can be exhibited by the non-woven fabric that is obtained by melt-blowing the above copolymer or the resin composition.

The melt-blown non-woven fabric is the one formed by the melt-blowing method and which can be said to be a randomly integrated material of non-continuous fibers (micro fibers) having fine fiber diameters. To prepare the melt-blown non-woven fabric, the polymer that is used must have a property of being formed into micro fibers (spinnability), and the formed fibers must have a strength to some degree at the smallest.

First, the ethylene-α-olefin copolymer used in the present invention has a density of as small as 0.900 g/cm$^3$ or less and the crystallinity of as small as from 5 to 40% compared with those of the conventional olefin-type resin for forming non-woven fabrics. However, the fibers obtained by using the above copolymer exhibit unexpected elasticity. So far, in general, an intimate relationship has been observed between the fiber-forming property or physical properties of the fibers and the density or crystallinity of the polymer that constitutes the fibers. Even in the case of the olefin-type resins, it has been believed that those having a large density or crystallinity exhibit excellent fiber-forming property and affort to obtaining fibers having excellent physical properties. According to the present invention, however, it was discovered that the ethylene-α-olefin copolymer exhibits exceptionally excellent non-woven fabric-forming property upon melt-blowing and that the obtained non-woven fabric exhibit excellent elasticity despite of its low density and crystallinity.

Furthermore, the melt-blown non-woven fabric obtained from the ethylene-α-olefin copolymer exhibits elasticity that increases drastically with an increase in the weight.

According to the present invention, the weight should be usually greater than 5 g/m$^2$ and, preferably, greater than 10 g/m$^2$ By increasing the weight, an increased elasticity is imparted to the non-woven fabric, which is desirable.

Thus, the melt-blown non-woven fabric of the present invention can be used for such applications as a material for clothing, medical supplies and hospital supplies presenting advantages in that they fit well to the bent portions or to the portions having complex shapes owing to their resiliency and that they undergo expansion and contraction or deformation accompanying the expansion, contraction or deformation of the portions to where the non-woven fabric is applied, suppressing deviation in position, wrinkles, peeling or removal.

The melt-blown non-woven fabric of the present invention can be used by itself for the above-mentioned applications, as a matter of course. Generally, however, it is desired to use the melt-blown non-woven fabric for various application in a form in which it is laminated onto the widely-known dry-type non-woven fabric as a unitary structure. That is, the above non-woven fabric having elasticity tends to give somewhat tacky and sticky feeling. When it is laminated on the dry-type non-woven fabric, however, the hand and the touch can be improved.

According to the second embodiment of the present invention, a distinguished feature resides in that the melt-blown non-woven fabric comprises a resin composition which contains, with the two components as a reference, 98 to 40% by weight of a polypropylene and 2 to 60% by weight of an ethylene-α-olefin copolymer having a density of smaller than 0.900 g/cm$^3$ and a crystallinity of from 5 to 40%.

First, the resin composition used for obtaining the melt-blown non-woven fabric consists chiefly of a polypropylene and an ethylene-α-olefin copolymer blended therewith has a density of less than 0.900 g/cm$^3$ which is smaller than that of the ordinary polyethylene or of the linear low-density polyethylene, and further has a crystallinity of as small as from 5 to 40%, thus making a difference from the low-temperature melting binder fibers of the prior art.

It was discovered that when a non-woven fabric is obtained by melt-blowing a blend of the polypropylene and the above particular ethylene-α-olefin copolymer in accordance with the present invention, the thus obtained non-woven fabric exhibits heat-workability, i.e., heat-adhesiveness at a low temperature and fibrous condition retaining property that are not expected from the melt-blown non-woven fabrics of conventional propylene resins, and further exhibits markedly improved softness.

When the melt-blown non-woven fabric is used for a final application, the individual fibers constituting the non-woven fabric must be bonded together by heating or the like method maintaining every predetermined distance from the standpoint of maintaining dimensional stability and strength either when it is used by itself or when it is used being stuck to other non-woven fibers. In bonding the fibers together by heating, if the fibers that carry stress are completely melted, the non-woven fabric loses strength and softness. It is therefore necessary to so bond the fibers together that some fibers retain their shape and physical properties and other fibers are at least softened to accomplish the bonding. This is the reason why the fibers constituting the integrated mat of thermoplastic polymeric micro fibers which have diameters of smaller than about 10 microns and which are largely non-continuous have a softening point which is lower by about 10° C. to 40° C. than the softening point of the fibers constituting a web of filaments which have a diameter of greater than about 12 microns, and are deposited in a random fashion, are molecularly oriented and are substantially continuous in the stuck non-woven fabric disclosed in Japanese Patent Publication No. 11148/1985. The same reason also applies to the latter binders fibers of a blend which chiefly comprises a polyethylene.

On the other hand, the non-woven fabric obtained by melt-blowing the blend of the polypropylene and the above particular ethylene-α-olefin copolymer in compliance with the present invention, exhibits markedly improved heat-adhesiveness at a relatively low temperature while exhibiting almost the same melting property as the initial polypropylene.

In general, the polymer constituting the fibers melts accompanying the melting of crystals in the polymer, and its properties can usually be learned from an endothermic melting curve of the differential scanning calorimetry (DSC). That is, the peak in the melting curve represents a melting point (Tm), and a point at which an asymptote of a rising part toward the endothermic side of the melting curve intersects the background is referred to as a softening point (Tf) in the present invention.

The accompanying FIG. 4 shows a melting curve by the DSC of a polypropylene alone which is a chief component of the resin composition of the present invention. It will be recognized from this melting curve that the polypropylene usually has a softening point (Tf) over a range of 125° to 135° C. and has a melting point (Tm) over a range of 160° to 170° C.

The accompanying FIGS. 5 and 6 are melting curves by the DSC of resin composition of when the polypropylene and the ethylene-α-olefin copolymer are blended at ratios of 95:5 and 80:20 by weight. These melting curves indicate an astonishing fact that the resin compositions usually have softening points (Tf) over a range of from 120° to 130° C. and melting points (Tm) over a range of from 160° to 170° C., i.e., the compositions have melting points which are almost the same as that of the polypropylene by itself and have softening points which are almost the same as that of the polypropylene by itself or which are slightly lower than that of the polypropylene, but the difference in the softening point is 10° C. at the greatest and is usually smaller than 5° C.

It the case of FIG. 5 where the ethylene-α-olefin copolymer is blended in a small amount, an endothermic peak simply appears in the form of a short shoulder. In the case of FIG. 6 where the ethylene-α-olefin copolymer is blended in a large amount, on the other hand, there appear a sub-melting curve due to the melting of the ethylene-α-olefin copolymer on a side of the temperature considerably lower than the main melting curve. The sub-melting curve indicates that the ethylene-α-olefin copolymer in the resin composition usually has a softening point (Tf) over a range of from 120° to 130° C. and a melting point (Tm) over a range of from 160° to 170° C. In FIG. 6 it is considered that a softening point of 66° C. and a peak at 84.1° C. on the low temperature side are attributable to the ethylene-α-olefin copolymer.

The above results of measurement indicate the fact that in the fibers constituting the melt-blown non-woven fabric, the polypropylene which is a chief component and is serving as a skeleton of the fibers exists in the same crystalline structure as the fibers composed of the polypropylene by itself, and exhibits the same fibrous condition retaining property and strength retaining property under the temperature conditions where the fibers composed of the polypropylene by itself maintains the fibrous condition retaining property and strength.

Next, Table 3 appearing later show adhered conditions or strengths of when a spun-bonded non-woven fabric composed of the polypropylene by itself is stuck to the melt-blown non-woven fabric that comprises the polypropylene alone and to the melt-blown non-woven fabrics comprising the resin compositions of the polypropylene and the ethylene-α-olefin copolymer blended at weight ratios of 90:10 and 80:20 by the heat-embossing at different temperatures (for details, reference should be made to working examples appearing later).

These results tell that the melt-blown non-woven fabric composed of the polypropylene by itself does not adhere well at a temperature as low as 115° C. or is peeled off among the layer if it is adhered, and is bonded or is adhered to such a degree that the fibers themselves undergo cohesive destruction only when the heat-embossing temperature has reached the softening point (Tf) of the polypropylene or around that value. On the other hand, the melt-blown non-woven fabric composed of the resin composition of the present invention can be heat-adhered even at a temperature which is considerably lower than the softening point (Tf) of the resin composition, the adhesion being accomplished to such a degree that the fibers themselves undergo cohesive destruction. That is, according to the present invention, the fibers themselves can be heat-adhered or bonded together, and can be further stuck to other non-woven fabrics by heating at temperatures of 110° to 120° C. which are exceptionally low from the standpoint of the polypropylene fibers and over a temperature range of as wide as from 110° to 130° C.

Moreover, the above-mentioned results of measurement and testing tell that the fibers of the melt-blown non-woven fabric of the present invention have a particular structure in cross section. That is, the melting curves by the DSC of FIGS. 5 and 6 indicate that the polypropylene and the ethylene-α-olefin copolymer exist as independent layers in the fiber structure or, in other words, that the polypropylene that is a chief component of the fibers exists as a continuous phase and the ethylene-α-olefin copolymer exists as a dispersed phase establishing an islands-in-the-sea structure or a relationship of a root of lotus and its pores.

The melt-blown non-woven fabric of the present invention exhibits mechanical properties and heat resistance comparable to those of the polypropylene itself while exhibiting heat-adhesiveness at low temperatures and softness that are not quite recognized in the melt-blown non-woven fabric of the polypropylene by itself, probably because the polypropylene and the ethylene-α-olefin copolymer exist maintaining the above-mentioned fine structure in the fibers.

BRIEF DESCRIPTION OF THE DRAWINGS

FIG. 1A is a sectional view illustrating laminates of a melt-blown non-woven fabric of the present invention showing a diagram of a two-layer laminate.

FIG. 1B is a sectional view illustrating laminates of a melt-blown non-woven fabric of the present invention showing a diagram of a three-layer laminate.

FIG. 2 is a sectional view showing an example of using a laminate of a melt-blown non-woven fabric according to a first embodiment of the present invention;

DESCRIPTION OF THE PREFERRED EMBODIMENTS

Figure 3:
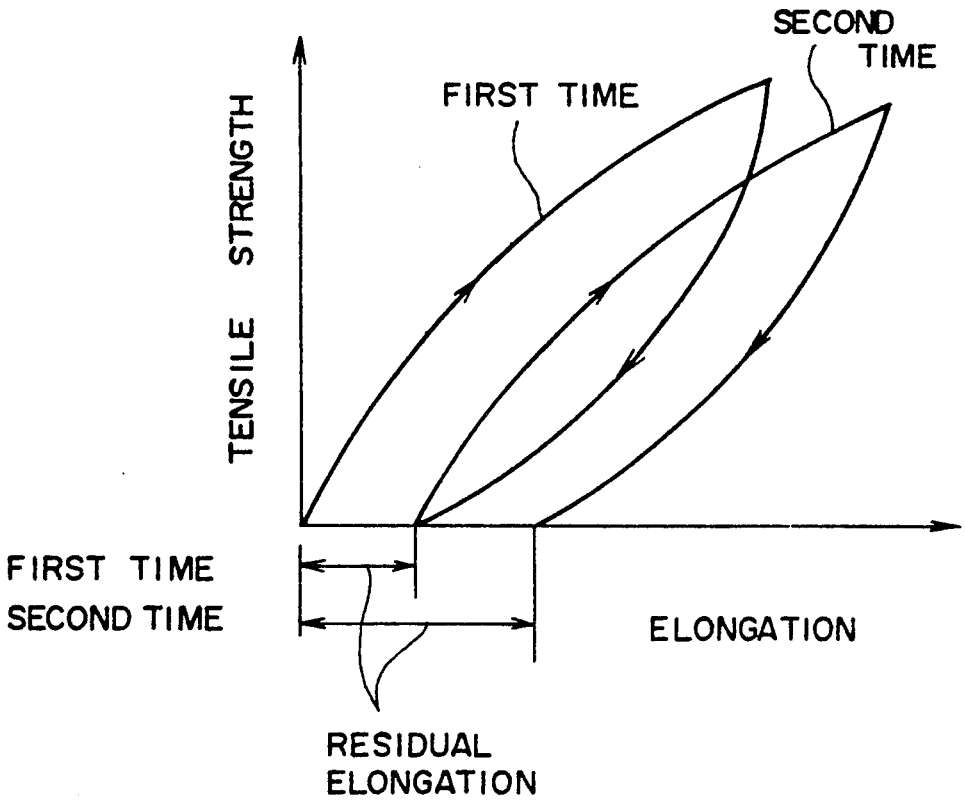
FIG. 3 is a diagram which schematically illustrates a hysteresis graph of the melt-blown non-woven fabric of the first embodiment of the present invention.
Figure 4:
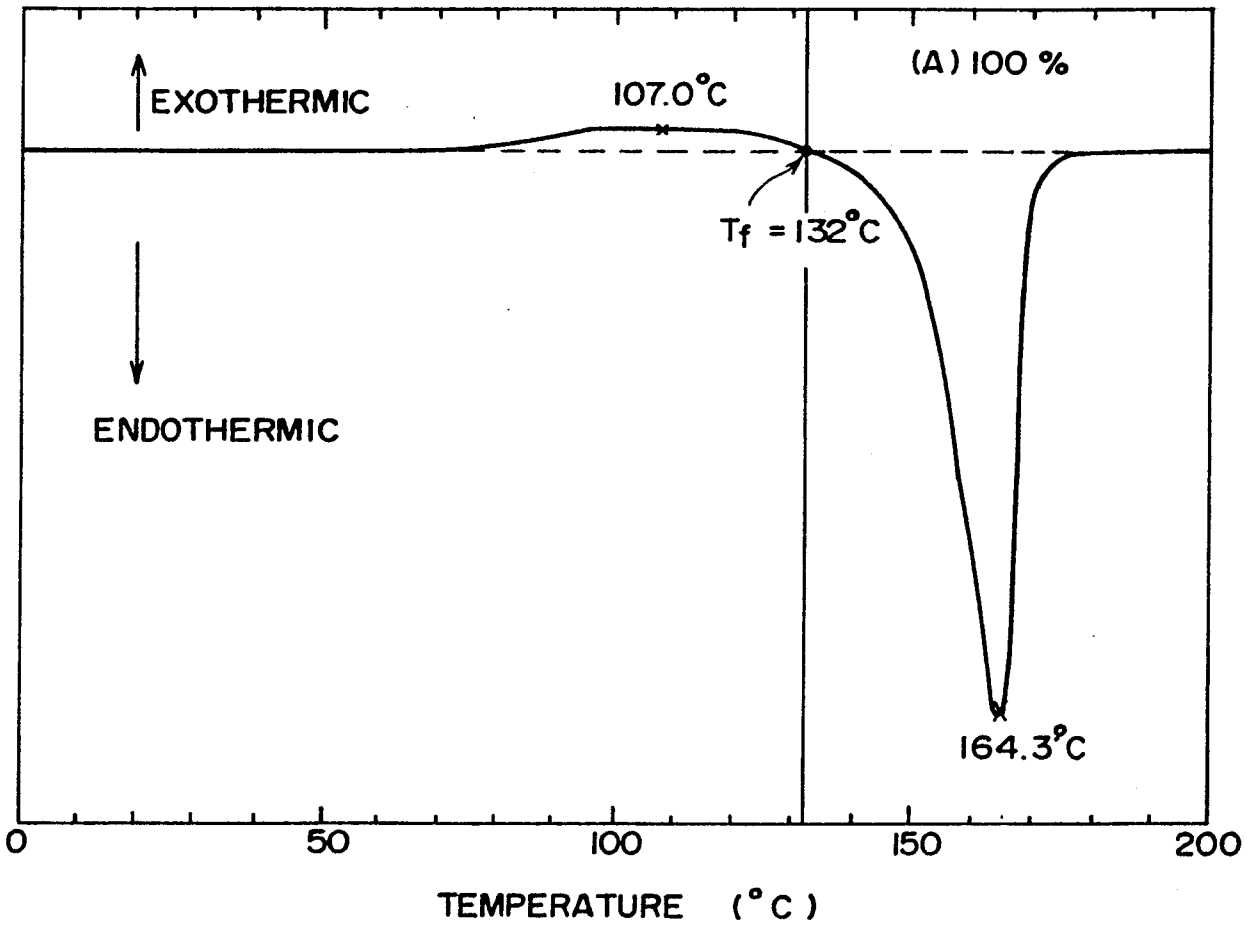
FIG. 4 is a diagram of a melting curve by the DSC of a polypropylene (A) by itself which is a chief component of a resin composition that forms a melt-blown non-woven fabric according to a second embodiment of the present invention.
Figure 5:
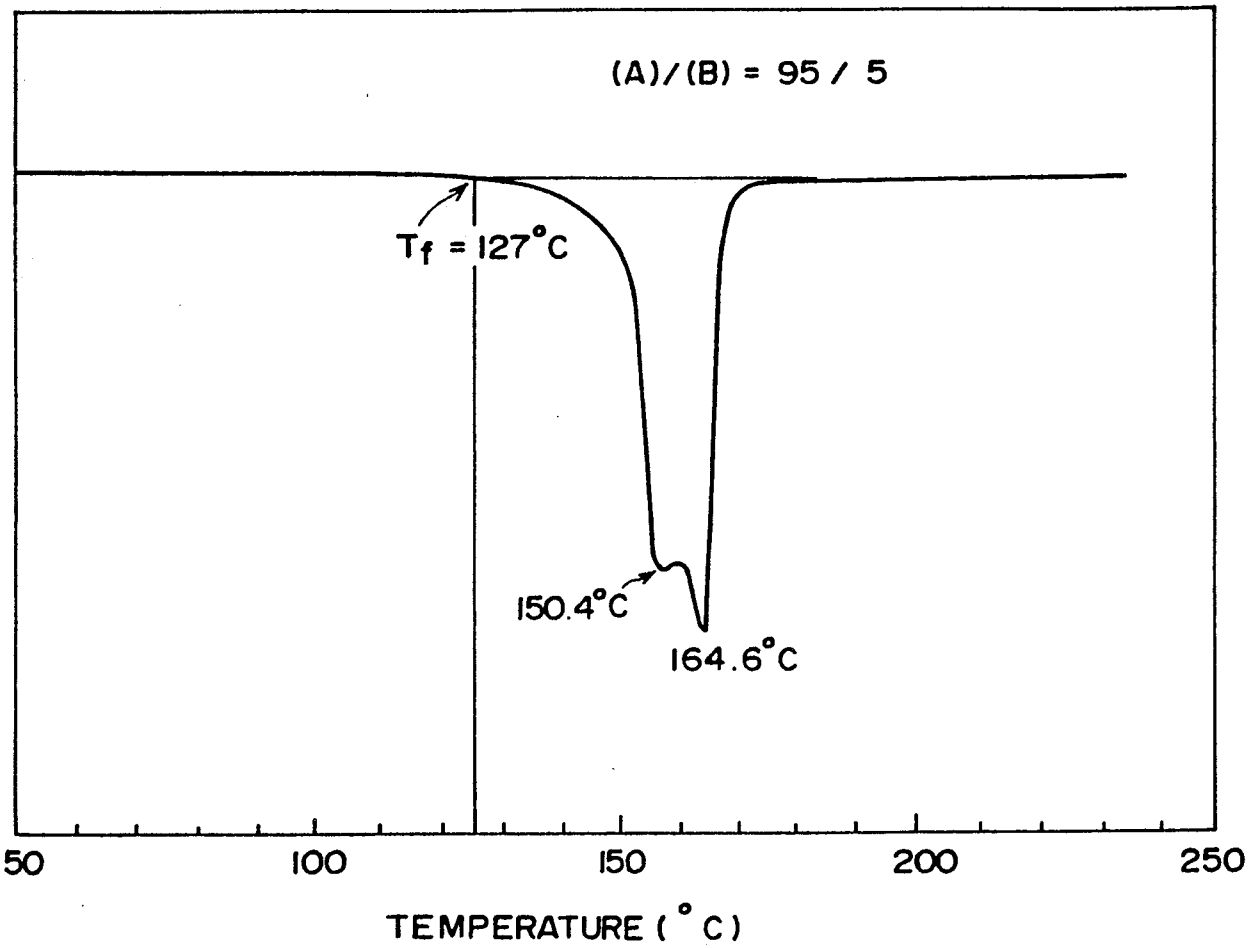
FIG. 5 is a diagram of a melting curve by the DSC of a resin composition used in the present invention consisting of the polypropylene (A) and an ethylene-a-butene random copolymer (B) blended at a weight ratio of 95:5 according to the second embodiment of the present invention.
Figure 6:
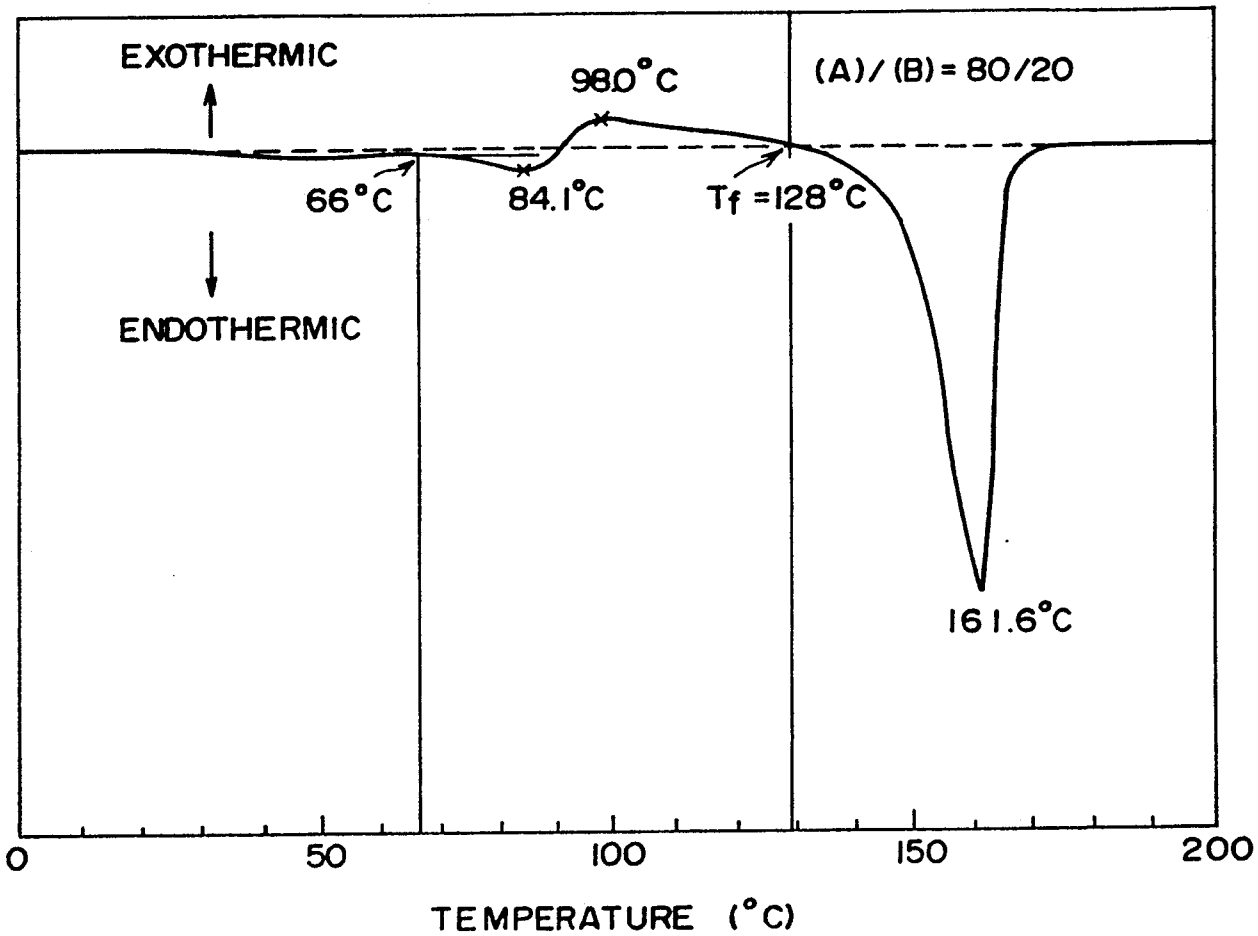
FIG. 6 is a diagram of a melting curve by the DSC of a resin composition used in the present invention consisting of the polypropylene (A) and the ethylene-1-butene random copolymer (B) at a weight ratio of 80:20.
Figure 7:
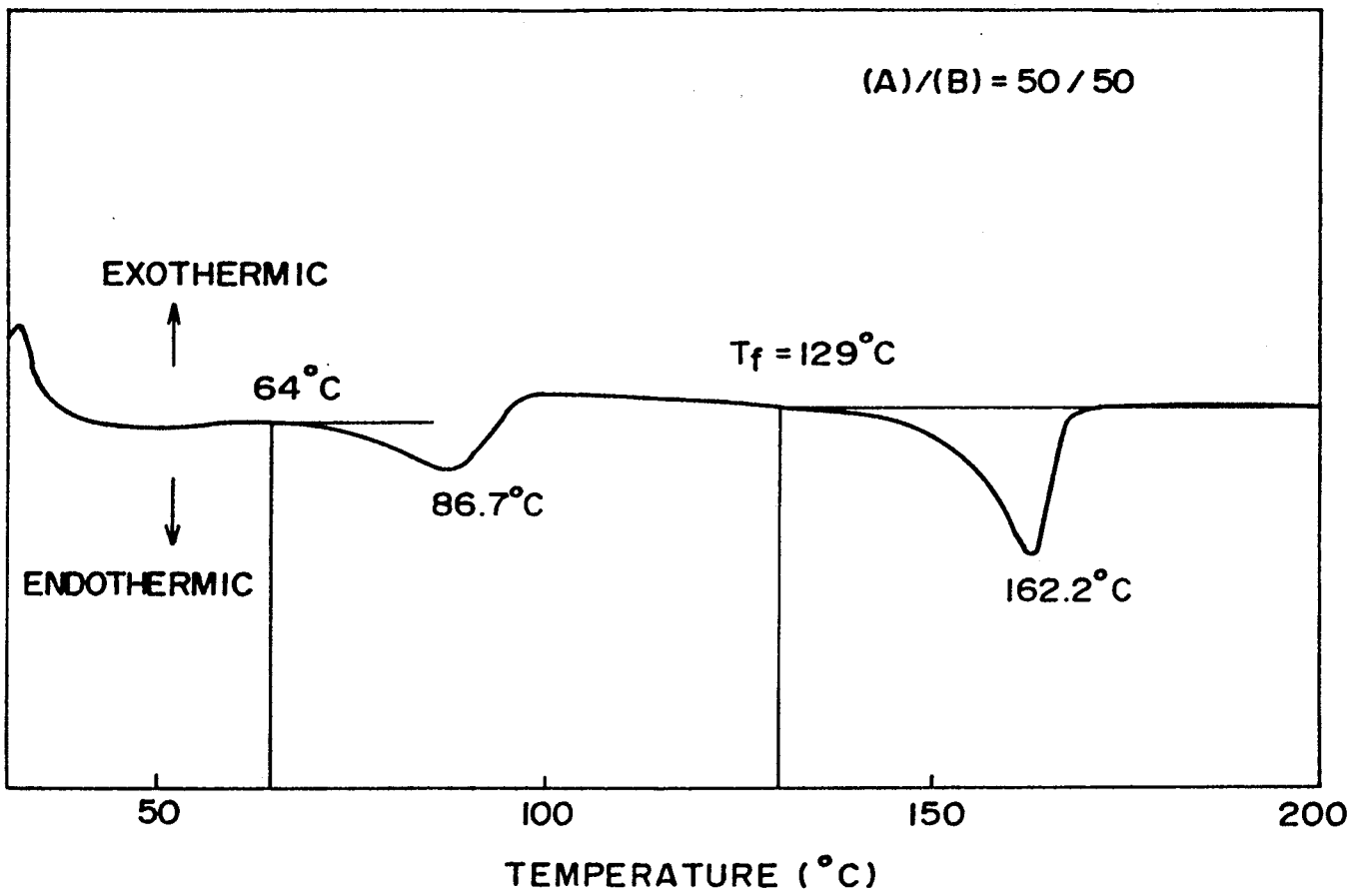
FIG. 7 is a diagram of a melting curve by the DSC of a resin composition used in the present invention consisting of the polypropylene (A) and the ethylene-1-butene random copolymer (B) at a weight ratio of 50:50.

The non-woven fabric according to a first embodiment of the present invention will now be described in detail.

Material

In order to accomplish the aforementioned actions, the ethylene-α-olefin copolymer used in the present invention must have a density of smaller than 0.900 g/cm$^3$ and a crystallinity of from 5 to 40%, and should preferably have the properties mentioned earlier.

In the copolymer, the α-olefin to be copolymerized with ethylene should, generally, be the one having 3 to 10 carbon atoms, such as a propylene, a 1-butene, a 1-pentene, a 1-hexene, a 4-methyl-1-pentene, a 1-octene, a 1-decene, or a mixture thereof and, whereby, the particularly preferred example is the α-olefin with 3 to 5 carbon atoms and, especially, the 1-butene.

The copolymer should have a melt index of from 0.1 to 200 g/10 min, and preferably from 1 to 50 g/10 min. When the melt index is smaller than 0.1 g/10 min, the flowability and fiber-forming property become poor to hinder the formation of micro fibers. When the melt index exceeds 200 g/10 min, on the other hand, the mechanical strength decreases causing the obtained non-woven fabric to lose the strength.

The copolymer should have a density of greater than 0.870 g/cm$^3$ but smaller than 0.900 g/cm$^3$, and preferably over a range of from 0.875 to 0.895 g/cm$^3$. When the density is greater than 0.900 g/cm$^3$, the copolymer loses elastic property, and the melt-blown non-woven fabric obtained therefrom fails to exhibit sufficiently large elasticity. When the density is smaller than 0.870 g/cm$^3$, on the other hand, the resin tends to become sticky, and the melt-blown non-woven fabric obtained therefrom tends to become blocked.

The crystallinity by X-rays of the copolymer has a relationship to the density thereof, and should be within a range of from 5 to 40% and, preferably within a range of from 7 to 30%. When the crystallinity exceeds 40%, the elastic property becomes insufficient and when the crystallinity becomes smaller than 5%, the melt-blown non-woven fabric obtained therefrom tends to become blocked.

It is desired that the melting point (in compliance with the method of ASTM D3418) found from a peal of an endothermic melting curve by the DSC of the copolymer at a temperature-elevating rate of 10° C./min. is greater than 40° C. and, preferably, from 60° to 100° C. When the melting point is smaller than 40° C., the obtained melt-blown non-woven fabric loses heat resistance.

In order to prepare a copolymer having the above-mentioned properties according to the present invention, there can be employed a method of copolymerizing an ethylene with an α-olefin with 3 to 10 carbon atoms in the presence of a solvent by using a catalyst consisting of an organoaluminum compound and a vanadium compound such as a vanadyl trichloride, a monoethoxyvinadyl dichloride, a triethoxyvinadyl, a vanadium oxydiacetyl acetonate or a vinadium triacetyl acetonate. Here, the organoaluminum compound represented by the formula, $$R_nAlX_{3-n}$$

wherein R is a hydrocarbon group such as an alkyl group, n is a number satisfying a relation $0<n<3$, and X is a hydrogen atom, a chlorine atom, or an alkoxy group with 2 to 4 carbon atoms, is preferably used as a cocatalyst. Or, there may be used a mixture of two or more compounds provided an average composition complies with the above experimental formula.

According to the present invention, it is preferred to use the ethylene-α-olefin copolymer by itself. As required, however, there may be used being blended other resins in such amounts that they do not impair the inherent properties of the ethylene-α-olefin copolymer. Though there is no particular limitation, examples of such resins include a low-, medium- or high-density polyethylene, a linear low-density polyethylene, a polypropylene, a polybutene-1, an ethylene-vinyl acetate copolymer, an ionically crosslinked olefin copolymer, an ethylene-acrylic acid ester copolymer, and the like. These polymers should be used in amounts of smaller than 100 parts by weight and, particularly, smaller than 80 parts by weight per 100 parts by weight of the ethylene-α-olefin copolymer.

The resin employed in the present invention may be blended with blending agents which are known per se. such as a heat stabilizer, a catalyst blocking agent, an antioxidizing agent, an ultraviolet ray-absorbing agent, and a coloring-agent.

Melt-blown non-woven fabric

The melt-blown non-woven fabric according to the present invention is obtained by extruding a molten resin composition to fine resin streams which are then brought into contact with a heated gas at a high speed to obtain non-continuous fibers of fine diameters, and integrating the fibers on a porous support material.

In producing the non-woven fabric, the components are, as required, dry-blended by using the Henschel's mixer, V-type blender or the like, or are melt-blended by using a monoaxial or a multi-axial extruder. After melted and kneaded, the resin composition is extruded through a die for melt-blowing to form fine resin streams It is desired that the melting and kneading are usually carried out at a temperature of from 230° to 380° C. and, particularly, at a temperature of from 250° to 330° C. When the temperature is lower than the above range, the melt viscosity becomes too great and the resin composition cannot be extruded into fine resin streams. When the temperature is higher than the above range, on the other hand, the molecular weight of the resin decreases due to the thermal degradation and the non-woven fabric loses mechanical properties.

A heated gas of a high speed can be introduced into the die for melt-blowing. The resin streams are brought in contact with the heated gas of a high speed thereby to form non-continuous fibers having fine fibrous diameters. The heated gas of a high speed may generally be the heated air from the standpoint of the cost. In order to prevent the resin from being degraded, however, there may be used a heated inert gas. It is desired that the heated gas has a temperature of usually from 240° to 390° C., and particularly from 260° to 340° C., which is higher by at least 10° C. than the temperature at which the resin is melted and kneaded. It is further desired that the heated gas flows at a speed of generally from about 100 to about 600 m/sec, and particularly from about 200 to about 400 m/sec. The resin stream and the heated gas of a high speed are brought in contact with each other inside or outside the die for melt-blowing: the resin stream is split, drafted under the molten condition, and stretched in the lengthwise direction of fibers, such that the fibers become more fine. Non-continuous fibers having fine fibrous diameters, i.e., web-like fibers blown from the melt-blowing die are integrated on a porous support material to obtain a non-woven fabric.

In the present invention, the weight of the non-woven fabric and the diameter and length of the individual fibers differ depending upon the applications, and cannot be readily determined. In general, however, the weight should range from 5 to 150 g/m$^2$ and, particularly, from 40 to 100 g/m$^2$, the fiber diameter should range from 0.1 to 10 μm and, particularly, from 1 to 9 μm, and the fiber length should range in average from 50 to 200 mm and, particularly, from 80 to 150 mm.

The melt-blown non-woven fabric of the present invention by itself can be used as a material of clothing, medical supplies, as a pharmaceutical material, as a cleaning material and like materials, and can further be put to a variety of applications being laminated on various non-woven fabrics, nets of various materials, or papers.

Laminated material of non-woven fabric

The FIGS. 1A and 1B illustrate laminates of non-woven fabrics of the present invention. The FIG. 1A laminate is of the two-layer type and consists of a layer 1 of the melt-blown non-woven fabric of the aforementioned copolymer and a layer 2 of another non-woven fabric laminated on one surface thereof. The laminate B of the three-layer type and consists of the layer 1 of the melt-blown non-woven fabric of the aforementioned copolymer, and layers *2a* and *2b* of another non-woven fabric laminated on both surfaces thereof. The non-woven fabric of other than the aforementioned copolymer used in this embodiment may be any non-woven fabric material that has been known per se. The non-woven fabric which is laminated may be a natural fiber such as a cotton; a regenerated fiber such as a rayon, an olefin-type resin such as a polypropylene, a polyester fiber such as a polyethylene terephthalate, a polyamide fiber such as nylon 6 or nylon 6,6, or a synthetic fiber such as an acrylic fiber, which may be used in one kind or in a combination of two or more kinds.

The non-woven fabric for being laminated may be comprised of staple fibers or filament fibers. Though there is no particular limitation, the single yarn size of the fibers should be of a small denier and, particularly, 1 to 3 deniers from the standpoint of hand and touch. Though there is no particular limitation in the means for producing the non-woven fabric, there can be used any non-woven fabric obtained by the dry method such as those of the form of a thin web obtained by putting stable fibers and, particularly, curled staple fibers to the carding machine, or those obtained by integrating at random the spun filaments or the drafted material thereof on a porous support material.

The non-woven fabric covers the surface of the elastic non-woven fabric of the aforementioned copolymer and may have a considerably small weight which, however, should generally range from 10 to 50 g/m$^2$ and, particularly, from 20 to 40 g/m$^2$.

The laminated non-woven fabric which is particularly useful as a material for masks, clothing, medical supplies and hospital supplies, is obtained by laminating non-woven fabrics of cellulose fibers such as of rayon, cotton and the like. The laminated non-woven fabric is excellent in regard to hand, touch, moisture-adsorbing property and water-absorbing property.

Then laminated non-woven fabric of the present invention is obtained by superposing one or two or more layers of other non-woven fabrics on the layer of the melt-blown non-woven fabric of the above-mentioned copolymer in a manner that the fibers of these layers are intermingles with each other so that the layers are coupled together as a unitary structure. The fibers can be intermingled together by using such means as needle punching, air suction, water jet and the like, to which, however, the invention is in no way limited.

By utilizing the fact that the melt-blown non-woven fabric of the present invention exhibits excellent heat-adhesiveness at a low temperature, furthermore, a laminate of the melt-blown non-woven fabric and other non-woven fabric is subjected to the step of heat-adhesion fastening such as heat-embossing thereby to obtain a final non-woven fabric having a stabilized dimension and improved strength. The heat-adhesion fastening will be the one in which the surfaces of the non-woven fabrics are heat-adhered together at intermittent and discrete regions as has been described in the prior art mentioned earlier.

Referring to FIG. 2 which shows another example of the non-woven fabric of the present invention, there is shown a laminate 3 used for a cataplasm for applying medicine to a diseased part. The laminate 3 comprises the layer 1 of the melt-blown non-woven fabric of the aforementioned copolymer, a layer 4 of a non-woven fabric having resistance against chemicals and laminated on one surface thereof, and a medicine layer 5 provided on the layer of the non-woven fabric having resistance against chemicals.

The cataplasm is stuck to an elbow or a knee under a condition were it is slightly bent. However, the cataplasm which uses the conventional non-woven fabric has its base material deviated without expanded when the hand or the leg is deeply bent or, on the other hand, has its base material greatly wrinkled when the hand or the leg is stretched, causing the medicine to be leaked. With the laminate of the present invention, however, the layer of the melt-blown non-woven fabric is very rich in softness and expands or contracts well accompanying the motion of the skin, and is not wrinkled or stretched, and does not cause medicine to be leaked.

The non-woven fabric having resistance against chemicals can be suitably selected from those non-woven fabrics that have excellent resistance against chemicals, and, among them, the non-woven fabric consisting of the polyester fiber is particularly suited for this purpose. The medicine layer may be that of a medicine for external application that has been known per se. such as methyl salicylate, salicylic acid glycolate, and the like.

The non-woven fabric according to the second embodiment of the present invention will be described next.

Resin Composition

The resin composition used for obtaining the non-woven fabric according to the second embodiment of the present invention comprises 98 to 40% by weight of a polypropylene (A) and 2 to 60% by weight of an ethylene-α-olefin copolymer having a density of smaller than 0.900 g/cm$^3$ and a crystallinity of from 5 to 40%. In the present invention, the polypropylene is used as a chief component of the resin composition because of the reason that the polypropylene exhibits excellent properties required for the fibers, exhibits excellent spinnability when it is melt-blown, and further exhibits excellent sanitary properties. This composition contains the ethylene-α-olefin copolymer as a component for reforming the non-woven fabric. When the content of this component is smaller than the above-mentioned range, however, the softness and the heat-adhesiveness at a low temperature are not sufficiently improved. When the content of this component is greater than the above-mentioned range, on the other hand, the melt-blown non-woven fabric loses mechanical properties and heat resistance.

The blending ratio of the resin composition is suitably selected within the above-mentioned range depending upon the expected properties and applications. For instance, for those applications where it is strongly desired to improve the softness and heat-adhesiveness at a low temperature, the blending ratio on the weight basis should be A:B=80:20 to 40:60 and, particularly, 75:25 to 50:50. For the applications where it is desired o improve the mechanical properties and heat resistance of the melt-blown non-woven fabric while guaranteeing minimum of softness and heat-adhesiveness at a low temperature, on the other hand, the ratio on the weight basis should be A:B=98:2 to 80:20 and, particularly, 98:2 to 90:10.

It is desired to use a crystalline propylene homopolymer as the polypropylene (A). It is desired that the polypropylene has a melting property by the aforementioned DSC. The polypropylene should have a fiber-forming property, as a matter of course, and its melt flow rate (MFR)(ASTM D 1238, condition L) should usually range from 10 to 300 g/10 min, more preferably from 20 to 100 g/10 min, and particularly preferably from 30 to 50 g/10 min. It should also be understood that there can be further used a crystalline random or block copolymer of the propylene and a small amount of other α-olefin within a range in which they satisfy the abovementioned conditions.

The α-olefin in the crystalline copolymer may be the one having 2 to 10 carbon atoms other than the propylene. Concretely speaking, the α-olefin may be an ethylene, a 1-butene, a 1-pentene, a 1-hexene, a 4-methyl-1-pentene, a 1-octene, a 1-decene, or a mixture thereof. Among them, the ethylene is particularly preferred. The α-olefin other than the propylene should exist in an amount of smaller than 10 mol % and, particularly, smaller than 5 mol % per the whole amount.

In the resin composition constituting the non-woven fabric of the second embodiment of the present invention, the ethylene-α-olefin copolymer (B) which is another component is the one that has the same composition as the ethylene-α-olefin copolymer used for the non-woven fabric of the aforementioned first embodiment. Moreover, the copolymer (B) should have a melt index (ASTM D 1238, condition E) of from 0.1 to 200 g/10 min., and preferably from 1 to 150 g/10 min. When the melt index is smaller than 0.1 g/10 min., the flowability and the dispersion property become so poor that the aforementioned fine structure is not established. When the melt index exceeds 200 g/10 min., on the other hand, the mechanical strength so decreases that when the copolymer is mixed with the polypropylene (A) to form the non-woven fabric, the strength of the non-woven fabric tends to decease.

The copolymer (B) should have a density of greater than 0.870 g/cm$^3$ but smaller than 0.900 g/cm$^3$, and preferably from 0.875 to 0.895 g/cm$^3$. When the density is greater than 0.900 g/cm$^3$, the copolymer does not work to improve the softness or the adhesiveness at a low temperature even when it is mixed with the polypropylene (A). When the density is smaller than 0.870 g/cm$^3$, on the other hand, the resin exhibits sticky feeling. When it is mixed with the polypropylene (A) to form the melt-blown non-woven fabric, therefore, there arises such an inconvenience that the non-woven fabric tends to be blocked.

The crystallinity by X-rays of the copolymer (B) has a relationship to the density thereof, and should be from 5 to 40% and, preferably, from 7 to 30%. When the crystallinity exceeds 40%, the softness and adhesiveness at a low temperature are not improved even when it is mixed with the polypropylene (A). When the crystallinity is smaller than 5%, on the other hand, the copolymer exhibits sticky feeling. When the copolymer is mixed with the polypropylene (A) to obtain a melt-blown non-woven fabric, therefore, there arises such an inconvenience that the non-woven fabric tends to be blocked.

It is desired that the melting point found from a peak of an endothermic melting curve by the DSC of the copolymer (B) at a temperature-elevating rate of 10° C./min. is from 40° to 100° C., and particularly, from 60° to 90° C. When the melting point exceeds 100° C., the heat-adhesiveness at a low temperature is little improved even when the copolymer is mixed with the polypropylene (A). When the melting point is lower than 40° C., on the other hand, the melt-blown non-woven fabric loses heat resistance.

Melt-blown non-woven fabric

The melt-blown non-woven fabric according to the present invention is obtained by extruding a molten resin composition to form fine resin streams which are then brought into contact with a heated gas of a high speed thereby to obtain non-continuous fibers of fine diameters, and integrating the fibers on a porous support material.

In producing the non-woven fabric, the two resin components are dry-blended by using the Henshel's mixer, V-type blender or the like, or are melt-blended by using a monoaxial or a multi-axial extruder. After melted and kneaded, the resin composition is extruded through a die for melt-blowing to form fine resin streams. It is desired that the melting and kneading are usually carried out at a temperature of from 200° to 350° C. and, particularly, at a temperature of from 220° to 300° C. When the temperature is lower than the above range, the melt viscosity becomes too great and the resin composition cannot be extruded into fine resin streams. When the temperature is higher than the above range, on the other hand, the molecular weight of the polypropylene decreases due to the thermal degradation and the non-woven fabric loses mechanical properties.

A heated gas of a high speed can be introduced into the die for melt-blowing. The resin streams are brought in contact with the heated gas of a high speed thereby to form non-continuous fibers having fine fibrous diameters. The heated gas of a high speed may generally be the heated air from the standpoint of the cost. In order to prevent the resin from being degraded, however, there may be used a heated inert gas. It is desired that the heated gas has a temperature of usually from 210° to 360° C., and particularly from 230° to 310° C., which is higher by at least 10° C. than the temperature at which the resin is melted and kneaded. It is further desired that the heated gas flows at a speed of generally from about 100 to 600 m/sec, and particularly from about 200 to 400 m/sec. The resin stream and the heated gas of a high speed are brought in contact with each other inside or outside the die for melt-blowing: the resin stream is split, drafted under the molten condition, and stretched in the lengthwise direction of fibers, such that the fibers become more fine. Non-continuous fibers having fine fibrous diameters, i.e., web-like fibers blown from the melt-blowing die are integrated on a porous support material to obtain a non-woven fabric.

In the present invention, the weight of the non-woven fabric and the diameter and length of the individual fibers differ depending upon the applications, and cannot be readily determined. In general, however, the weight should range from 5 to 100 g/m$^2$ and, particularly, from 10 to 80 g/m$^2$, the fiber diameter should range from 0.1 to 10 μm and, particularly from 1 to 6 μm, and the fiber length should range in average from 50 to 200 mm and, particularly, from 80 to 150 mm.

Heat-adhesion and Sticking

The melt-blown non-woven fabric of the present invention by itself exhibits heat-adhesiveness at a low temperature as well as mechanical strength and heat resistance comparable to those of the polypropylene alone. Therefore, the melt-blown non-woven fabric is subjected to the step of heat-adhesion fastening such as heat-embossing in the form of a single sheet or being overlapped in required number of sheets, in order to obtain a final non-woven fabric having stabilized dimension and improved strength.

the step of heat-adhesion fastening is carried out by passing the melt-blown non-woven fabric through the heated and compressed embossing rolls. The heat-adhesion fastening will be the one in which the surfaces of the non-woven fabrics are heat-adhered together at intermittent discrete regions as has been described in the prior art mentioned earlier. The non-woven fabric is adhered by the application of heat and pressure by at least using a roll having protrusions that serve as heat-adhesion regions distributed over the whole surface thereof maintaining a predetermined distance, or by using a pair of rolls having protrusions that are so provided as to intersect each other. There can further be employed a thermal melt-adhesion method based on ultrasonic wave vibration instead of using the heat-embossing.

As described already, the temperature for the heat-adhesion should range from 110° to 135° C. However, the invention does not exclude the cases where the heat-adhesion is carried out at temperatures higher than the above range, as a matter of course. There is no particular limitation on the pressure provided the rolls and the non-woven fabric are brought into reliable contact with each other. However, the pressure may range, for instance, from 10 to 30 kg/cm in line pressure. Moreover, the gaps among the points of heat-adhesion fastening may generally range from about 5 to about 30 mm and, particularly, from about 10 to about 20 mm.

In a preferred embodiment of the invention, a reinforcing layer or, preferably, a spun-bonded non-woven fabric obtained by the spun-bonding method is stuck to at least one surface of the above melt-blown non-woven fabric by the heat-emboss working in order to obtain a laminated non-woven fabric material. This makes it possible to impart excellent softness to the non-woven fabric and to markedly improve mechanical strength and durability of the non-woven fabric. Examples of the reinforcing layer include papers, woven fabric composed of a synthetic resin such as polyethylene terephthalate, nylon, etc., non-woven fabrics, nets and the like.

Any widely known spun-bonded non-woven fabric can be used as a spun-bonded non-woven fabric in this embodiment. A representative spun-bonded non-woven fabric on a porous support material. The spun-bonded non-woven fabric of this type comprises continuous filaments which are molecularly oriented by stretching, and exhibits particularly excellent strength. In the spun-bonded non-woven fabric, the fibers have been intermingled together by such means as needle punching, air suction, water jet or the like.

The spun-bonded non-woven fabric used in the present invention may be comprised of any synthetic fiber such as of a polypropylene, a polyester, a polyamide or the like, but should preferably be comprised of a polypropylene. The amount of weight of the spun-bonded non-woven fabric should generally range from 10 to 100 g/m$^2$ and, particularly, from 15 to 50 g/m$^2$. Furthermore, the size of the filament should generally range from 1 to 3 deniers.

The laminate of the melt-blown non-woven fabric and the spun-bonded non-woven fabric may assume any laminate constitution such as melt-blown non-woven fabric/spun-bonded non-woven fabric, melt-blown non-woven fabric/spun-bonded non-woven fabric/melt-blown non-woven fabric, spun-bonded non-woven fabric/melt-blown non-woven fabric/spun-bonded non-woven fabric, etc.

The melt-blown non-woven fabric and other non-woven fabrics can be stuck together by heat-melting under the aforementioned conditions for heat-adhesion fastening.

EXAMPLES

The invention will now be described more concretely by way of working examples.

EXAMPLE 1

An ethylene-1/butene random copolymer having an ethylene content of 91.0 mol %, a crystallinity of 20%, a melting point (Tm) of 86° C., a density of 0.891 g/cm$^3$ and an MFR of 18 g/10 min. was thrown into a monoaxial extruder of a diameter of 40 mm, melted therein at 280° C. (temperature at the cylinder head), and was molded through a melt-blowing die connected to the end thereof. The die was of a single row having a width of 0.6 m, and the air heated at 300° C. was introduced at a flow rate of 90 m$^3$/Hr.

The blowing rate of the resin was 7 kg/Hr and the weight of the web was adjusted to be 20, 30, 50, 70 and 100 g/m$^2$. The take-up speed was 6.5 m/min. in the case of a product having a weight of 30 g/m$^2$.

The thus produced melt-blown non-woven fabrics having the above-mentioned weights were evaluated for their elastic property in compliance with a method of testing modulus of elasticity of extension stipulated under JIS L-1096. It was found that the melt-blown non-woven fabric were all rich in elastic property and exhibited excellent elasticity. The results were as shown in Table 1.

The smaller the value of residual elongation in Table 1, the larger the elastic property of the melt-blown non-woven fabric subjected to the testing. FIG. 3 is a diagram which schematically illustrates a hysteresis graph found by the testing of modulus of elasticity of extension.

As for the measuring method, a test piece (50×300 mm) of the non-woven fabric was set to a tension tester (No. 2005 manufactured by Intesco Co.) such that the distance between the chucks was 200 mm. The room temperature was 23° C. and the relative humidity was 50%.

The test piece was pulled at a pulling speed of 20 mm/min. until a predetermined elongation (20 mm) is reached, and was then allowed to return back to the initial condition at the same speed, and the load was removed. In this case, the test pieces remains in an elongated condition without returning to the initial position. This condition is referred to as the residual elongation of the first time as shown in Table 1.

Immediately thereafter, the test piece is pulled again for the second time until a predetermined elongation (20 mm) is reached just like in the first time, and was allowed to return back to the initial condition. The length of elongation after the load is removed is referred to as the residual elongation of the second time. The chart speed was 200 mm/min.

TABLE 1

| Example No. | Weight (g) | Tensile direction | Residual elongation (mm) 1st time | 2nd time |
|---|---|---|---|---|
| 1 | 20 | vertical | 1.4 | 1.9 |
| | | lateral | 1.6 | 1.9 |
| 1 | 30 | vertical | 1.5 | 1.8 |
| | | lateral | 1.8 | 1.9 |
| 1 | 50 | vertical | 1.3 | 1.5 |
| | | lateral | 1.7 | 2.0 |
| 1 | 70 | vertical | 1.7 | 2.0 |
| | | lateral | 1.7 | 1.9 |
| 1 | 100 | vertical | 1.6 | 1.9 |

TABLE 1-continued

| Example No. | Weight (g) | Tensile direction | Residual elongation (mm) 1st time | 2nd time |
|---|---|---|---|---|
| | | lateral | 1.7 | 1.8 |

EXAMPLE 2 (LAMINATED MATERIAL OF NON-WOVEN FABRIC) AND COMPARATIVE EXAMPLES 1,2

The ethylene-1/butene random copolymer described in Example 1 was thrown into a monoaxial extruder of a diameter of 40 mm, melted therein at 280° C. (temperature at the cylinder head), and was molded through a melt-blowing die connected to the end thereof. The die was of a single row having a width of 0.6 m, and the air heated at 300° C. was introduced at a flow rate of 90 $m^3$/Hr.

The blowing rate of the resin was 7 kg/Hr and the weight of the web was adjusted to be 50 g/$m^2$. The take-up speed was 4 m/min. The melt-blown non-woven fabric that serves as a substrate was thus prepared.

Next, a dry-type non-woven fabric was prepared by using a rayon staple fiber having a single yarn size of 2 deniers and a fiber length of 51 mm. A carding machine having a width of 30 cm was used to shape the non-woven fabric. That is, a web of about 8 g/$m^2$ was prepared by using the carding machine, and was laminated one upon another into four layers by a wrapper. The laminate was drafted to some extent at the time of take-up in order to obtain a non-woven fabric having a final weight of 30 g/$m^2$.

The above melt-blown non-woven fabric and the rayon-carded non-woven fabric were laminated one upon another and were stuck together by the water jet method. The water jet working was performed under the following conditions: i.e., after the pre-wetting, the surface A was put to 50 kg/$cm^2$ through two stages and then 80 kg/$cm^2$ through two stages and, thereafter, the surface B was put to the same treatment at a speed of 10 m/min.

The thus obtained laminated material of non-woven fabric was evaluated for its elastic property in the same manner as in Example 1 in compliance with a method of testing the modulus of elasticity of extension stipulated under JIS L-1096. As comparative samples, a polypropylene melt-blown non-woven fabric (Comparative Example 1) having a weight of 100 g/$m^2$ and a dry-method polyethylene terephthalate (PET) non-woven fabric (Comparative Example 2) having a weight of 100 g/$m^2$ were also evaluated. The results obtained were as shown in Table 2.

It was confirmed that the non-woven fabric of Example 2 was rich in elastic property, and exhibited excellent elasticity, good fitness to the face, good touch, and lent itself well for being used as a mask.

EXAMPLE 3

The ethylene-1/butene random copolymer described in Example 1 was thrown into a monoaxial extruder of a diameter of 40 mm, melted therein at 280° C. (temperature at the cylinder head), and was molded through a melt-blowing die connected to the end thereof. The die was of a single row having a width of 0.6 m, and the air heated at 300° C. was introduced at a flow rate of 90 $m^3$/Hr.

The blowing rate of the resin was 7 kg/Hr, and the weight of the web was adjusted to be 50 g/$m^2$ The take-up speed was 4 m/min. The melt-blown non-woven fabric that serves as a substrate was thus prepared.

Next, a dry-type non-woven fabric was prepared by using a polyester staple fiber having a single yarn size of 2 deniers and a fiber length of 51 mm. A carding machine having a width of 30 cm was used to shape the non-woven fabric. That is, a web of about 8 g/$cm^2$ was prepared by using the carding machine, and was laminated one upon another into four layers by a wrapper. The laminate was drafted to some extent at the time of take-up in order to obtain a non-woven fabric having a final weight of 30 g/$m^2$.

The above melt-blown non-woven fabric and the polyester-carded non-woven fabric were laminated one upon another and were stuck together by the water jet method. The water jet working was performed under the following conditions: i.e., after the pre-wetting, the surface A was put to 50 kg/$cm^2$ through two stages and then 80 kg/$cm^2$ through two stages and, thereafter, the surface B was put to the same treatment at a speed of 10 m/min.

The thus obtained laminated material of non-woven fabric was evaluated for its elastic property in compliance with the method of testing the modulus of elasticity of extension stipulated under JIS L-1096. The results obtained were as shown in Table 2 below.

The laminated material of non-woven fabric of Example 3 was rich in elastic property, and exhibited excellent elasticity and excellent fitness to the elbow, knee and neck. The following medicine composition was applied in an amount of 300 g/$m^2$ to the surface of the polyester layer of the laminated material of non-woven fabric.

| (Main components in one gram) | |
|---|---|
| Methyl salicylate | 190 mg |
| Salicylic acid glycolate | 10 mg |
| di-camphor | 70 mg |
| 1-menthol | 60 mg |
| capsaicine | 0.25 mg |
| nicotinic acid benzyl ester | 0.2 mg |
| eucalyptus oil | 10 mg |
| thymol | 10 mg |

The cataplasm was stuck to the lower part of the neck and to the shoulder of a person who feels stiff in the shoulder. After the exercise under the condition in which the cataplasm was stuck, the cataplasm did not develop peeling or wrinkles, and excellent therapeutic effect was obtained.

TABLE 2

| Sample No. | Weight (g) | Tensile direction | Residual elongation (mm) 1st time | 2nd time |
|---|---|---|---|---|
| Example 2 | 50*1) 30*2) | vertical lateral | 1.7 1.8 | 1.8 1.9 |
| Example 3 | 50*1) 30*2) | vertical lateral | 1.9 1.8 | 2.0 1.9 |
| Comp. Ex. 1 (PP) | 100 | vertical lateral | 5.9 6.0 | 6.7 6.9 |
| Comp. | 100 | vertical | 5.7 | 6.5 |

TABLE 2-continued

| Sample No. | Weight (g) | Tensile direction | Residual elongation (mm) 1st time | 2nd time |
|---|---|---|---|---|
| Ex. 2 (PET) | | lateral | 5.8 | 6.7 |

*1)Weight (g/m²) of the melt-blown non-woven fabric of the ethylene-1/butene random copolymer.
*2)Weight (g/m²) of the dry-type non-woven fabric.
Comp. Ex.: Comparative Example

EXAMPLE 4

A polypropylene (A) having a softening point of 132° C. and a melting point 164.3° C. as measured by the DSC, a density of 0.19 g/cm³ and an MFR of 35 g/10 min. (ASTM D 1238, condition L) and an ethylene-1/butene random copolymer (B) having an ethylene content of 91.0 mol%, a crystallinity of 20%, a melting point (Tm) of 86° C., a density of 0.891 g/cm³ and an MFR of 18 g/10 min. were blended together at a weight ratio of 95/5 to prepare a starting material for melt-blowing. These compounds were blended in a vat by hand.

The blended composition was thrown into a monoaxial extruder having a diameter of 65 mm, melted therein at 350° C. (temperature of the cylinder head), and was molded through melt-blowing dies connected to the end thereof. The dies were in two rows having a diameter of 1.3 m, and the air heated at 380° C. was introduced at a flow rate of 500 m³/Hr.

The blowing rate of the resin was 20 kg/Hr, and the weight of the web was adjusted to be 29 g/m² The take-up speed was about 13 m/min.

Next, a spun-bonded non-woven fabric was stuck to both sides of the web by the heat-embossing. The spun-boned non-woven fabric was made of a polypropylene or Stratek RW-2022 (produced by Idemitsu Petrochemical Co., Fiber size, 4 deniers; weight, 22 g/m²; (η) 1.17 dl/g). The embossing material was the off-line embossing material produced by Sunrex Kogyo Co., which possessed three delivering layers, a diameter of the embossing roll of about 25 cm, and an effective width of 1.5 m, and was of the oil circulation heated type.

The laminate of a constitution of spun-bonded non-woven fabric/melt-blown non-woven fabric/spun-bonded non-woven fabric was inserted in the embossing rolls so as to be stuck together. The roll temperature was 125° C., the line pressure was 20 kg/cm, and the processing was carried out at a speed of 50 m/min. There was obtained a non-woven fabric material of a three-layer constitution without interlayer peeling.

COMPARATIVE EXAMPLE 3 AND EXAMPLES 5 TO 7

In the above Example 4, the polypropylene (A) and the ethylene-1/butene random copolymer (B) were blended at weight ratios (A):(B) of 100:0 (Comparative Example 3), 90:10 (Example 5), 80:20 (Example 6), and 50:50 (Example 7), in order to prepare melt-blown non-woven fabrics. These melt-blown non-woven fabrics and the spun-bonded non-woven fabrics were laminated in the same manner as in Example 4. The conditions best suited for the sticking were found through the experiment described below.

The degree of interlayer adhesion was examined while changing the temperature of the embossing roll by 5° C. every time. The results were as shown in Table 3 below. It was found that when the copolymer (B) was not blended, the adhesion was not sufficient and the interlayer peeling took place when the temperature was lower than 120° C. When the copolymer (B) was blended in an amount of greater than 10%, the materials were broken even when the temperature was 120° C. In the product containing the copolymer (B) in an amount of 20%, the materials were broken even when the temperature was 115° C. and in the product containing the copolymer (B) in an amount of 50%, the materials were broken even when the temperature was lower than the above temperature, manifesting that the layers had been favorably stuck together.

When the temperature was raised, on the other hand, the non-woven fabrics poorly parted from the embossing rolls in all of the cases when the temperature was higher than 135° C., making it difficult to carry out the processing, from which it was found that the copolymer (B) composition permits a wide range of conditions. When the copolymer (B) was blended, the layers could be adhered together over a temperature range of as wide as from 110° to 130° C.

DSC (Measurement of Differential Scanning Calorimetry)

Table 3 shows softening points found from an endothermic melting curve by the DSC of the samples, i.e., shows intersecting points of the backgrounds and asymptotes at the rising part toward the endothermic side of the melting curve, as well as the peak temperatures (melting points) on the melting curve. FIGS. 4 to 7 illustrate melting curves by the DSC of Comparative Example 3 and of Examples 4, 6 and 7. The melting curve of Example 5 was almost the same as that of Example 4.

Measuring Conditions for DSC

Depending upon the samples being measured, the measurement of DSC may differ between a temperature-rising chart of the first time and the temperature-rising chart of the second time after the sample has been cooled and coagulated. According to the present invention, however, the softening points and melting points are those read from the temperature-rising chart of the first time.

| | |
|---|---|
| Measuring instrument | Model DSC 7 manufactured by Perkin-Elmer Co. |
| Temperature-rising rate | 10° C./min. |
| Temperature calibration | indium |
| Weight of sample | about 5 to 10 mg |

TABLE 3

| Sample No. | (A)/(B) | Softening point (°C.) | Melting point (°C.) | Temperature of embossing roll 110° C. | 115° C. | 120° C. | 125° C. | 130° C. |
|---|---|---|---|---|---|---|---|---|
| Comparative Example 3 | 100/0 | 132 | 164.3 | X | X | Δ | ○ | ○ |
| Example 4 | 95/5 | 127 | 164.6 | X | Δ | ○ | ○ | ○ |
| Example 5 | 90/10 | 127 | 164.6 | X | Δ | ○ | ○ | ○ |

TABLE 3-continued

| Sample No. | (A)/(B) | Softening point (°C.) | Melting point (°C.) | Temperature of embossing roll 110° C. | 115° C. | 120° C. | 125° C. | 130° C. |
|---|---|---|---|---|---|---|---|---|
| Example 6 | 80/20 | 68<br>128 | 84.6<br>161.6 | Δ | ○ | ○ | ○ | ○ |
| Example 7 | 50/50 | 64<br>129 | 86.7<br>162.2 | ○ | ○ | ○ | ○ | |

○: Material broken
Δ: Surface peeled off
X: not adhered

EXPERIMENTAL EXAMPLE

The non-woven fabric materials prepared in Comparative Example 3 and Examples 5 to 7 were quantitatively measured for their touch smoothness. The measurement was taken by using a friction tester, Model KES-SE, produced by Katohtek Co. This instrument quantitatively measures the touch of a substance which is felt by human skin in terms of two kinds of numerical values, i.e., slipping property (MIU) and smoothness (MMD), and is widely used for evaluating paper diapers and tissue papers. The smaller the values MIU and MMD, the more slippery and smooth the non-woven fabrics are. The significant differences for the values MIU and MMD are 0.02 or greater for MIU and 0.002 or greater for MMD.

The following Table 4 shows the measured results of the non-woven fabric materials.

TABLE 4

(Values measured by using a friction tester)

| (A)/(B) | 100/0 | 90/10 | 80/20 | 50/50 |
|---|---|---|---|---|
| MID | 0.28 | 0.25 | 0.23 | 0.21 |
| MMD | 0.012 | 0.010 | 0.009 | 0.008 |
| MID: | | slipping property (the smaller the more slippery) | | |
| MMD: | | smoothness (the smaller the more smooth) | | |
| Measuring instrument: | | Manufactured by Katohtek Co.<br>Friction tester<br>Model KES-SE | | |
| Measuring conditions: | | 23° C., 50% RH<br>load, 50 g<br>speed, 1 mm/sec.<br>distance of measurement, 30 mm | | |
| Significant difference: | | MIU, 0.02 or greater<br>MMD, 0.002 or greater | | |

It will be understood from the above results that the non-woven fabrics obtained from a blend of the polypropylene (A) and the ethylene-1/butene random copolymer (B) are superior in both slipping property and smoothness to the fabrics obtained from the starting material without blended with the ethylene-1/butene random copolymer (B).

We claim:

1. A melt-blown non-woven fabric of fine fibers obtained by melt-blowing an ethylene-α-olefin copolymer having a density of smaller than 0.900 g/cm$^3$ and a crystallinity of from 5 to 40% or by melt-blowing a resin composition which chiefly comprises said copolymer.

2. A melt-blown non-woven fabric according to claim 1, wherein said ethylene-α-olefin copolymer contains an α-olefin with 3 to 10 carbon atoms, and has an ethylene content of 85 to 95 mol %, a melt flow rate of 0.1 to 200 g/10 min. as measured at 190° C. under a load of 2160 g, a density of greater than 0.870 g/cm$^3$ but smaller than 0.900 g/cm$^3$, and a crystallinity of from 5 to 40%.

3. A melt-blown non-woven fabric according to claim 2, wherein the ethylene-α-olefin copolymer has a melting point (Tm) over a range of from 40° to 100° C.

4. A laminated material of non-woven fabric obtained by laminating as a unitary structure a melt-blown non-woven fabric according to any one of claims 1 to 3 and another non-woven fabric.

5. A mask composed of a laminated material of non-woven fabrics of claim 4.

6. A cataplasm comprising a melt-blown non-woven fabric of any one of claims 1 to 3, another non-woven fabric laminated on said melt-blown non-woven fabric, and a medicine layer applied onto said other non-woven fabric.

7. A melt-blown non-woven fabric of fine fibers obtained by melt-blowing a resin composition which contains, with the two components as a reference, 98 to 40% by weight of a polypropylene and 2 to 60 % by weight of an ethylene-α-olefin copolymer having a density of smaller than 0.900 g/cm$^3$ and a crystallinity of from 5 to 40%.

8. A melt-blown non-woven fabric of fine fibers according to claim 7, wherein said ethylene-α-olefin copolymer contains an α-olefin with 3 to 10 carbon atoms, and has an ethylene content of 85 to 95 mol %, a melt flow rate of 0.1 to 200 g/10 min. as measured at 190° C. under a load of 2160 g, a density of greater than 0.870 g/cm$^3$, and a crystallinity of from 5 to 40%.

9. A melt-blown non-woven fabric according to claim 8, wherein the ethylene-α-olefin copolymer has a melting point (Tm) over a range of from 40° to 100° C.

10. A melt-blown non-woven fabric according to claim 7, wherein said polypropylene has a softening point (Tf) over a range of from 125° to 135° C. as measured by the differential scanning calorimetry (DSC) and has a peak on the melting curve over a range of from 160° to 170° C.

11. A melt-blown non-woven fabric according to any one of claims 7 to 10, wherein the resin composition of the polypropylene and the ethylene-α-olefin copolymer has a softening point (Tf) over a range of from 120° to 130° C. and has a melting point (Tm) over a range of from 160° to 170° C.

12. A laminated non-woven fabric material obtained by sticking a reinforcing layer onto at least one surface of a melt-blown non-woven fabric of fine fibers obtained from a resin composition which contains, with the two components as a reference, 98 to 40% by weight of a polypropylene and 2 to 60% by weight of an ethylene-α-olefin copolymer having a density of smaller than 0.900 g/cm$^3$ and a crystallinity of from 5 to 40%, said reinforcing layer being heat-adhered over discrete regions maintaining a distance in the direction of the surface.

13. A laminated non-woven fabric material according to claim 12, wherein the reinforcing layer is a spun-bonded non-woven fabric.

14. A laminated non-woven fabric material according to claim 13, wherein the spun-bonded non-woven fabric comprises a polypropylene resin.

15. A medical supply comprising a laminated non-woven fabric of claim 12.

16. A cleaning material comprising a laminated non-woven fabric of claim 12.

17. A material for clothing comprising a laminated non-woven fabric of claim 12.

18. A melt-blown non-woven fabric of fine fibers obtained by melt-blowing of an ethylene-α-olefin copolymer, wherein said α-olefin contains 3 to 10 carbon atoms, and said ethylene-α-olefin copolymer has an ethylene content of 85 to 95 mol %, a density greater than 0.870 g/cm$^3$ and smaller than 0.900 g/cm$^3$ and a crystallinity of 5 to 40%.

19. A melt-blown non-woven fabric according to claim 18, wherein the α-olefin contains 3 to 5 carbon atoms.

20. A melt-blown non-woven fabric according to claim 18, wherein the α-olefin contains 1-butene.

21. A melt-blown non-woven fabric according to claim 18, wherein the copolymer has a crystallinity of 7 to 30%.

22. A melt-blown non-woven fabric of fine fibers obtained by melt-blowing a resin composition which contains 98–40% by weight of polypropylene and 2 to 60% by weight of an ethylene-α-olefin copolymer, wherein said α-olefin contains 3 to 10 carbon atoms, and said ethylene-α-olefin copolymer has an ethylene content of 85 to 95 mol %, a density greater than 0.870 g/cm$^3$ and smaller than 0.900 g/cm$^3$ and a crystallinity of 5 to 40%.

23. A melt-blown non-woven fabric according to claim 22, wherein the resin composition contains a polypropylene to ethylene-α-olefin weight ratio of 90:10 to 80:20.

24. A melt-blown non-woven fabric according to claim 22, wherein the resin composition contains a polypropylene to ethylene-α-olefin weight ratio of 75:25 to 50:50.

25. A melt-blown non-woven fabric according to claim 22, wherein the α-olefin contains 3 to 5 carbon atoms.

26. A melt-blown non-woven fabric according to claim 22, wherein the α-olefin comprises 1-butene.

27. A melt-blown non-woven fabric according to claim 22, wherein the ethylene-α-olefin copolymer has a crystallinity of 7 to 30%.

28. A method of producing a melt-blown non-woven fabric of fine fibers by extruded a molten resin composition which contains, with the two components as a reference, 98 to 40% by weight of polypropylene, and 2 to 60% by weight of an ethylene-α-olefin copolymer having a density smaller than 0.900 g/cm$^3$ and a crystallinity of 5 to 40% to form fine resin streams, bringing the resin streams into contact with a heated gas at a high speed to form non-continuous fibers of fine diameters, and integrating the fibers on a porous support material.

29. A method of producing a laminated non-woven fabric material by laminating a reinforcing layer on a melt-blown non-woven fabric of fine fibers obtained from a resin composition which contains, with the two components as a reference, 98 to 40% by weight of a polypropylene and 2 to 60% by weight of an ethylene-α-olefin copolymer having a density smaller than 0.900 g/cm$^3$ and a crystallinity of 5 to 40%, and heat-adhering them together at intermittent discrete regions on the surface of the non-woven fabric.

30. A method of producing a laminated non-woven fabric material according to claim 29, wherein the reinforcing layer is a spun-bonded non-woven fabric.

31. A method of producing a laminated non-woven fabric material according to claim 29, wherein the heat-adhesion is carried out at a temperature of 110° to 135° C.

32. A method of producing a laminated non-woven fabric material according to claim 29, wherein the heat-adhesion is carried out by heat-embossing.

33. A method of producing a laminated non-woven fabric material according to claim 29, wherein the heat-adhesion is carried out by ultrasonic wave vibration working.

34. A method of producing a melt-blown non-woven fabric of claim 28, wherein the ethylene-α-olefin copolymer has an ethylene content of 85 to 95 mol % and said α-olefin contains 3 to 5 carbon atoms.

35. A method of producing a laminated non-woven fabric material of claim 29, wherein the ethylene-α-olefin has an ethylene content of 85 to 95 mol % and said α-olefin contains 3 to 5 carbon atoms.

* * * * *